US006848518B2

(12) United States Patent
Chen et al.

(10) Patent No.: US 6,848,518 B2
(45) **Date of Patent: *Feb. 1, 2005**

(54) STEERABLE UNDERREAMING BOTTOM HOLE ASSEMBLY AND METHOD

(75) Inventors: Chen-Kang D. Chen, Houston, TX (US); William H. Smith, Jr., New Orleans, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 164 days.

This patent is subject to a terminal disclaimer.

(21) Appl. No.: 10/281,542

(22) Filed: Oct. 28, 2002

(65) Prior Publication Data

US 2004/0099444 A1 May 27, 2004

Related U.S. Application Data

(63) Continuation-in-part of application No. 09/956,174, filed on Sep. 18, 2001, now Pat. No. 6,470,977.

(51) Int. Cl.[7] ..... E21B 7/04
(52) U.S. Cl. ..... 175/61; 175/62; 175/74
(58) Field of Search ..... 175/73, 76, 74, 175/61, 62, 269, 268, 291, 406

(56) References Cited

U.S. PATENT DOCUMENTS

| | | | | | |
|---|---|---|---|---|---|
| 4,612,987 | A | * | 9/1986 | Cheek | 166/212 |
| 4,616,719 | A | * | 10/1986 | Dismukes | 175/94 |
| 5,060,736 | A | * | 10/1991 | Neff | 175/74 |
| 6,059,051 | A | * | 5/2000 | Jewkes et al. | 175/76 |
| 6,213,226 | B1 | * | 4/2001 | Eppink et al. | 175/61 |
| 6,269,892 | B1 | * | 8/2001 | Boulton et al. | 175/61 |
| 6,419,033 | B1 | * | 7/2002 | Hahn et al. | 175/61 |
| 6,470,977 | B1 | * | 10/2002 | Chen et al. | 175/61 |

FOREIGN PATENT DOCUMENTS

| | | | | | |
|---|---|---|---|---|---|
| BE | 1012545 | A3 | * | 12/2000 | E21B/00/00 |
| GB | 1435339 | A | * | 5/1976 | B23B/51/00 |

* cited by examiner

*Primary Examiner*—David Bagnell
*Assistant Examiner*—Daniel P Stephenson
(74) *Attorney, Agent, or Firm*—Browning Bushman

(57) ABSTRACT

A steerable bottom hole assembly may be used for drilling both a curved section and straight section of the borehole, with the bottom hole assembly including a reamer beneath the downhole motor 12. The bottom hole assembly includes a bit 30 having a bit face defining a bit diameter, and a gauge section 32 having a substantially uniform diameter cylindrical surface approximating the bit diameter and having an axially length of at least 75% of the bit diameter. The motor is preferably run slick without stabilizers for engaging the wall of the borehole.

20 Claims, 2 Drawing Sheets

STEERABLE UNDERREAMING BOTTOM HOLE ASSEMBLY AND METHOD

RELATED CASE

This application is a continuation-in-part of application Ser. No. 09/956,174 filed on Sep. 18, 2001 now U.S. Pat. No. 6,470,977.

FIELD OF THE INVENTION

The present invention relates to steerable bottom hole assemblies when used for underreaming or enlarging a section of a wellbore.

BACKGROUND OF THE INVENTION

Steerable bottom hole assemblies include a positive displacement motor (PDM) or "mud motor" which has a bend angle that allows a drilling operator to build at a desired rate when "sliding" the non-rotating motor housing. The bend angle of the bent sub or bent motor housing, in combination with the contact points of the bottom hole assembly (BHA) with the well bore wall, thus largely determines the build rate for drilling the curved borehole section. When the drill string and the motor housing are rotated, the drilling operator drills a straight or tangent section of the borehole. The rate of penetration (ROP) of the bit drilling through the formation is frequently significantly less when "sliding" to build rather than rotating the bottom hole assembly from the surface to drill the straight borehole sections. Since ROP translates to time and money, drilling operators prefer to maximize the time when the BHA is rotated for drilling straight, and minimize the time of building. For various reasons, high build rates are generally preferred, but the bend angle is preferably low to minimize problems when the BHA is rotated. A steerable bottom hole assembly is disclosed in U.S. Pat. No. 6,269,892. This patent discloses the benefits of a steerable bottom hole assembly with a long gauge bit, i.e., a bit having a gauge section with an axial length of at least 75% of the bit diameter.

Underreaming tools within the bottom hole assembly are used to enlarge a section of the well bore below a restriction. Advantages of underreaming are disclosed in an article "Simultaneous Drilling and Reaming Saves Rig Time", *Oil & Gas Journal*, Nov. 27, 1989. Conventional underreaming tools use three or more cutting arms that are moved outward in response to fluid pressure within the tool. A reamer designed for hole opening while drilling is the NBR reamer offered by Security DBS, a Halliburton Company.

When reamers are used in a conventional steerable bottom hole assembly immediately above the bit and below the motor housing, the bottom hole assembly has very poor steerability. More particularly, it is difficult to accurately predict the build rate when sliding, regardless of the positioning of stabilizers above the reamer. Because of high vibration, the azimuth of the curved borehole formed while sliding may be inaccurate. Moreover, borehole quality is generally poor due to high vibration, which prohibits the motor housing from "holding steady" in the well.

Because of the disadvantages of a steerable bottom hole assembly and reamer combination discussed above, operators have used bi-center bits rather than reamers for performing the underreaming operation. Bi-center bits are discussed in "Application of Bi-Center Bits in Well-Deepening Operations, IADC/SPE 19921, page 131. While bi-center bits may be a better solution than a reamer in some applications, significant problems remain when using a bi-center bit. Vibration due to the bi-center bit is significant, and the bottom hole assembly is also difficult to steer. Vibrations are particularly high when drilling relatively hard formations. High vibration not only increases the likelihood of failure in the bottom hole assembly, but is generally indicative of poor borehole quality. High vibration typically results in excessive bit wear. Drilling operators are constantly seeking techniques which will result in better hole quality when drilling with a steerable downhole motor. The bottom hole assembly also should have good steerability and preferably be able to drill at a relatively high ROP.

The disadvantages of the prior art are overcome by the present invention, and an improved steerable bottom hole assembly and method are hereafter disclosed for underreaming a section of borehole with relatively low vibration and high borehole quality.

SUMMARY OF THE INVENTION

A steerable bottom hole assembly according to the present invention is used for drilling both a curved section and a straight section of the borehole. The bottom hole assembly includes a downhole positive displacement motor having a motor housing and a bend angle. The motor housing encloses a shaft or rotor offset at a selected bend angle from a central axis of an upper housing, which encloses the power section of the motor. The motor is powered by fluid to rotate the bit when sliding to drill the curved section of the borehole, and the bottom hole assembly including the motor is rotated from the surface to drill the straight section of the borehole.

A gauge section is provided directly above the bit and has a substantially uniform diameter bearing surface with an axial length of at least 75% of the bit diameter. A reamer is positioned directly above the bit and has a reamer diameter significantly greater than the bit diameter for drilling an enlarged section of the borehole compared to the restricted diameter through which the bottom hole assembly has passed. The bottom hole assembly (BHA) of this invention may include a reamer which is hydraulically activated to force cutters radially outward to ream a diameter significantly larger than the cutting diameter of the bit.

It is an object of the present invention to provide a steerable bottom hole assembly which is useful for underreaming operations and results in relatively high borehole quality compared to prior art techniques.

It is a feature of the present invention that the bend-to-reamer distance is less than 15 times the reamer diameter, and preferably less than the 12 times the reamer diameter, thereby obtaining a relatively high build rate for a low angle bend in the motor. To provide this low bend-to-reamer and thus bend-to-bit distance, the lower end of the motor includes a pin connection at the end of the shaft or motor for mating engagement with a box connection at the upper end of the reamer. It is a feature of the present invention that the positive displacement motor is preferably run slick, i.e., with no stabilizers for engaging the wall of the well bore.

Another feature of the invention is that a near bit reamer (NRB) may run with shear pins set to a high pressure, so that an entire interval may be drilled by a bit without exceeding the shear rating. In this way, the interval may be drilled at the gauge of the bit. Once the well total depth is reached, the drilling mud may be switched over to a clean non-damaging completion fluid designed to create a filter cake that may be easily removed with an acid wash at the appropriate time.

It is another feature of the present invention to provide a bottom hole assembly with a single blade stabilizer positioned above the bend in the downhole motor.

In a preferred embodiment, the bend in the bottom hole assembly has a bend angle of less than 3°, and the gauge section has an axial length of at least 90% of the bit diameter.

A related feature of the present invention is to provide a method of forming a subterranean borehole utilizing a steerable bottom hole assembly as discussed above, including a reamer below the downhole motor for enlarging the borehole diameter substantially beyond the bit diameter. A gauge section is provided between the bit and the reamer to add stability to the BHA. The motor is powered with fluid to rotate the bit while the motor housing is slid to drill a curved section of the borehole, and the bottom hole assembly is rotated from the surface to build a straight section of the borehole.

A significant advantage of the present invention is that the bottom hole assembly does not require specially made components. Instead, each of the components of the bottom hole assembly may be selected by the operator as desired to achieve the objectives of the invention.

These and further objects, features, and advantages of the present invention will become apparent from the following detailed description, wherein reference is made to the figures in the accompanying drawings.

DETAILED DESCRIPTION OF PREFERRED EMBODIMENTS

Steerable drilling systems conventionally utilize a downhole motor (mud motor) powered by drilling fluid (mud) pumped from the surface to rotate the bit. The motor rotates the bit using a drive section, with the rotor output from the drive section extending through a bent sub or bent housing to rotate the bit. The bent sub may actually comprise more than one bend to obtain a net effect which is referred to as the "bend angle" of the bottom hole assembly. The downhole motor which utilizes a lobed rotor is referred to as a positive displacement motor (PDM).

Figure 1:
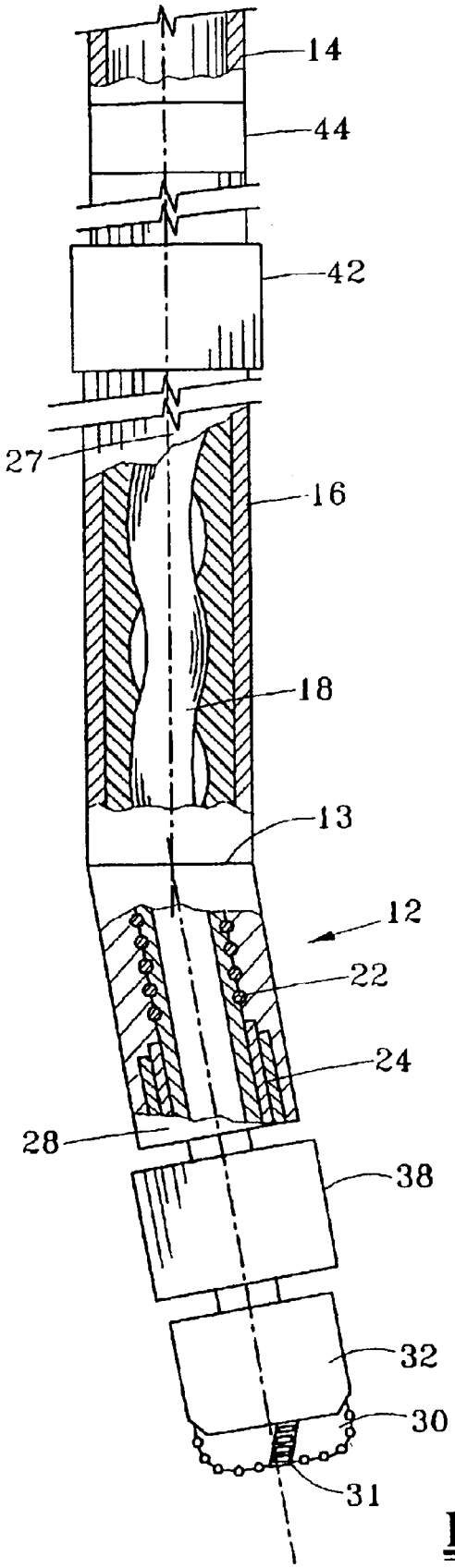
FIG. 1 is a simplified view of the bottom hole assembly according to the present invention for performing under-reaming operations.

FIG. 1 depicts a steerable bottom hole assembly (BHA) for drilling both a curved section and a straight section of the borehole. The BHA includes a PDM 12 which is conventionally suspended in the well from a tubular string 14, which is conventionally threaded drill pipe. PDM 12 includes a motor housing 16 with a substantially cylindrical outer surface and a conventional lobed rotor 18 within the power section of the motor for rotating the bit. The lower housing 22 includes a bearing package assembly 24 which conventionally comprises both thrust and radial bearings. The upper housing 26 has a central axis 27 which is offset at a selected angle from the central axis of the lower housing 28, thereby forming the bend 13. A reamer 30 is positioned below the motor 12, and is discussed further below.

The bottom hole assembly includes a rotary bit 30 having a bit end face 31 which defines a bit diameter. The bit includes a long gauge section 32 with an outer surface which forms a cylindrical bearing surface when the bit is rotating. The gauge section is fixed to and may be integral with the bit. The axial length of the gauge section is at least 75% of the bit diameter, and preferably the axial length of the gauge section is at least 90% of the bit diameter. In many applications, the gauge section axial length may be from 1 to 1½ times the bit diameter. The diameter of the gauge section may be slightly undergauged.

The gauge length is from the top of the gauge section to the bottom of the gauge section, and at least 50% of this gauge length has a substantially uniform diameter bearing surface. One or more short gaps or undergauge portions may thus be provided between the top of the gauge section and the bottom of the gauge section. The spacing from the top to the bottom of the gauge section will be the total gauge length, and that the portion which has the substantially uniform diameter bearing surface is at least 50% of the total gauge length.

Figure 2:
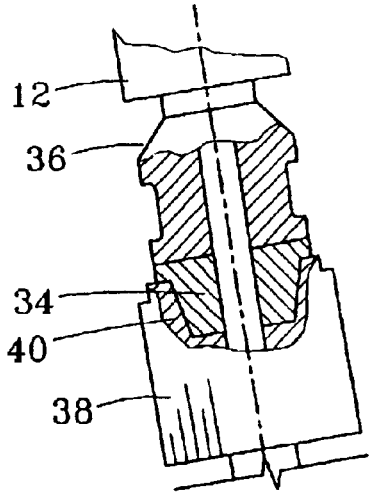
FIG. 2 is a cross-sectional view illustrating the mechanical interconnection between the lower end of the motor rotor and the box connection on the reamer.

It is a feature of the present invention to maintain a relatively short distance between the bit face and the bend 13, and also between the reamer and the bend. According to the present invention, the bend-to-reamer spacing maybe less than 15 times the reamer diameter, and preferably is less than 12 times the reamer diameter. In order to reduce the distance between the bend and the bit face, the PDM motor is preferably is provided with a pin connection 34, as shown in FIG. 2, at the lowermost end of the shaft 36, while the reamer 38 is provided with a box connection 40 at its uppermost end. The combination of the pin down motor and the box up reamer allows for shortening the bend to bit face distance.

According to the BHA of the present invention, the first point of contact between the BHA and the well bore is the bit face 31. The second point of contact between the BHA and the well bore is along the gauge section 32. The third point of contact between the BHA and the well bore is along the reamer 38. The motor housing including the bend in the BHA as shown in FIG. 1 does not contact the well bore, so that the fourth point of contact between the BHA and the well bore is spaced above the bend, and as shown in FIG. 1 is the reamer 42. Drill string stabilizers or other reamers may be provided above the reamer 42. The bottom hole assembly may also include an MWD system 44 positioned above the motor 12 for transmitting signals to the surface of the well in real time. The reamer 38 is used to enlarge the borehole to a diameter greater than the diameter of the bit, which approximates or is greater than the diameter of the casing string above the bottom hole assembly.

The PDM is preferably run "slick", i.e., with no stabilizers on the motor for engagement with the wall of the borehole. The PDM motor may include a slide or wear pad. The BHA as disclosed herein has surprisingly low vibration, which results in good borehole quality. The benefits of improved borehole quality include reduced hole cleaning, improved logging operations and log quality, easier casing runs, and more reliable cementing operations.

U.S. Pat. No. 6,269,892 discloses a steerable mud motor which has low vibration and results in high borehole quality when a long gauge section is provided immediately above the bit, and when the next contact point between the bottom hole assembly and the borehole is above the bend, and is typically spaced considerably above the bend in the motor. The use of a reamer between the PDM motor and the bit inherently adds to the bit-to-bend distance. By providing another tool for contact with the formation below the bend, which is also a formation cutting tool, the assumption would be that vibration would significantly increase, that the build rate would significantly suffer, that the predictability of the build rate would be reduced, and that borehole quality would deteriorate. This result has not occurred, which is surprising.

Table 1 provides predicted build/drop rates for different gauge outer diameters on the reamer 42 above the bend. The BHA has a bent angle of 1.15°, a bit inclination of 14°, and a weight on bit of 17,000 pounds. The reamer 38 below the bend has a diameter of 14 inches, and the bit diameter has 12.25 inches. The build/drop rates when sliding with the tool face on the high side, the low side, and neutral are provided for different diameters of the stabilizer or upper reamer 42. Most importantly, Table I indicates that the build rate when in the rotary mode is in the acceptable range when the upper reamer is ¼ inch or less undergauged from a lower reamer. According to the present invention, the diameter of the upper reamer above the bend in the BHA should be less than about ½ inch from the diameter of the lower reamer.

TABLE I

| Tool Face | 12.25" Stab | 13.75" Reamer | 13.875" Reamer | 14" Reamer |
|---|---|---|---|---|
| High Side | 7.87 | 7.34 | 7.23 | 7.12 |
| Low side | −5.83 | −7.19 | −7.30 | −7.42 |
| Neutral | 1.44 | 0.08 | −0.03 | −0.15 |
| Rotary Mode | 1.16 | 0.08 | −0.04 | −0.15 |

Initial tests have indicated that the bottom hole assembly of the present invention with a reamer above the gauge section and below the mud motor has very good build rates and predictable steerability. Although the build rates are lower than a BHA without a reamer, build rates were substantially better than prior art bottom hole assemblies used for underreaming a section of a borehole, including systems which use bi-centered bits with stabilizers on the motor housing. Most importantly, vibration is significantly reduced so that borehole quality is much better than that typically obtained when using a BHA with either a bi-centered bit, or a conventional bit and a reamer. Due to better bit stability, the sliding ROP for the bottom hole assembly is surprisingly high, and was even better than the rotating ROP of conventional BHA's used for underreaming operations. The build rate when sliding was only about 20 to 30% less than the build rate when sliding using a steerable BHA without a reamer. Accordingly, the BHA may be operated in the oriented or steerable mode for relatively long periods of time to counteract the slightly lower build rate. High vibration associated with downhole motors with a high bend angle may thus be further reduced.

For the embodiment as shown in FIG. 1, a second reamer 42 is provided substantially above the bend. The addition of this second reamer improves directional tendency and stability while drilling, particularly in hard formations, such as salt formations. When drilling in the rotary mode, this additional second reamer acts a stabilizer to reduce vibration. The build rate may be reduced by adding this additional reamer, since the elimination of this contact point with the borehole wall increases the side force build tendency and reactive forces on the components below the motor. A single blade stabilizer may be used for cost savings. A single-blade stabilizer may serve the function of the non-formation cutting second reamer and may pass through the casing and act like a normal, full circumference stabilizer when rotating. Additional drill collar stabilizers and/or additional reamers may be provided above the reamer 42.

Figure 3:
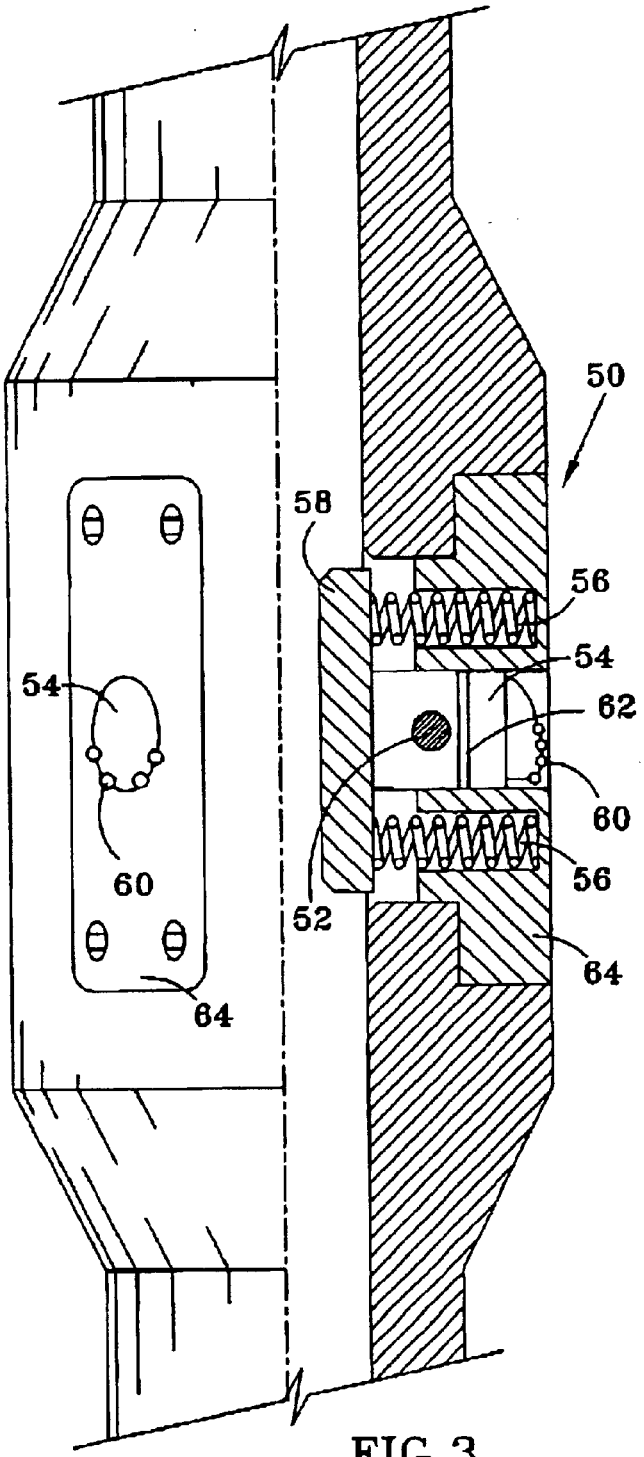
FIG. 3 illustrates a suitable reamer for reaming a hole diameter significantly greater than that of the bit.

With the BHA at a desired depth, shear pins 52 on the near bit reamer (NBR) 50 as shown in FIG. 3 may be sheared by pressurizing up the system, i.e., increasing pump rate. This allows the pistons 54 to extend and cutters 60 ream the formation to a dimension typically 20% or more greater than the original drill bit diameter. Springs 56 bias pad 58 secured to piston 54 in the radially inward position for retrieval to the surface. Seals 62 seal between the piston 54 and the face plate 64.

Figure 4:
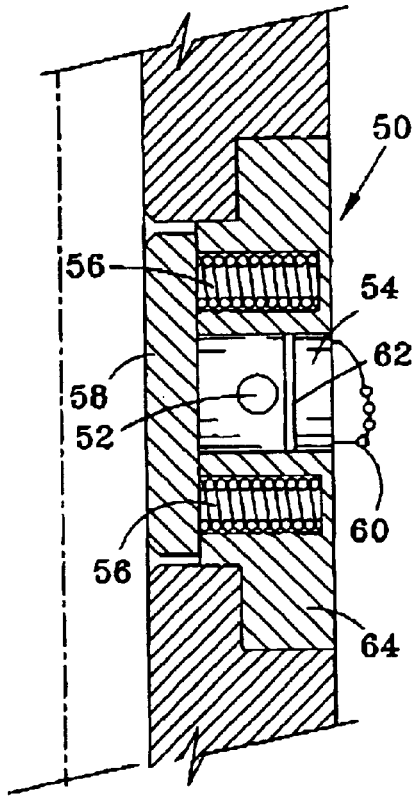
FIG. 4 is a cross-sectional view of reamer cutters in the radially outward position.

The hole may be reamed by applying weight to the bit to cut the bit hole, with the reamed hole above the bit hole. Alternatively, an interval may be reamed from the end of the well backward, i.e., while backing out of the hole, in which case the cutters 60 would point upward rather than downward as shown in FIG. 4. In this way, the borehole wall that has potentially been invaded and damaged by the dirty drilling fluid during drilling with the bit may be eliminated by enlarging the hole as the NBR moves uphole. Virgin rock is exposed, and the fluid that circulates at this time may be virgin completion fluid. A new filter cake may be laid. Since no dirty fluid has to circulate over this new exposed rock face, the fluid flow in the annulus (where the cutting action is taking place) is in an uphole direction. Previously proposed techniques for exposing rock face in an uphole direction required a second trip to bottom with a section mill. The present invention may overcome this second trip requirement by providing a BHA that may be run in a "locked down" or radially retracted position. A very true gauge hole may be formed which eliminates potential frictional pressure losses along the lateral (if drilling a deviated or offset section) that result from borehole spiraling. This method may be efficiently performed with a top drive assembly at the surface.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A steerable bottom hole assembly for drilling a borehole, comprising:

a downhole motor having a motor housing and a bend angle, the motor housing enclosing a lower output rotor offset at a selected bend angle from a central axis of an upper motor housing;

the bit having a bit face defining a bit diameter;

a gauge section having a substantially uniform diameter bearing surface approximating the bit diameter, the gauge section having an axial length at least 75% of the bit diameter; and a reamer positioned between the downhole motor and the gauge section, the reamer including cutters for enlarging the borehole diameter substantially beyond the bit diameter.

2. A bottom hole assembly as defined in claim 1, wherein the down hole motor is slick with no stabilizers for engaging the wall of the wellbore.

3. A bottom hole assembly as defined in claim 1, further comprising:

a second reamer positioned on the bottom hole assembly above the bend in the downhole motor.

4. A bottom hole assembly as defined in claim 1 , further comprising:

the output rotor having a pin connection at its lowermost end; and the reamer having a box connection at its upper end for mating interconnection with the pin connection.

5. A bottom hole assembly as defined in claim 1, wherein the cutters on the reamer move radially outward to a reamer cutting diameter in response to fluid pressure within the bottom hole assembly.

6. A bottom hole assembly as defined in claim 5, wherein the cutters on the reamer are biased radially inward.

7. A bottom hole assembly as defined in claim 5, further comprising:

a shear member to prevent the reamer cutters from moving to the reamer cutting diameter until fluid pressure increases above a selected level.

8. A bottom hole assembly as defined in claim 5, further comprising:

a plurality of pistons each moveable radially outward in response to fluid pressure to move the reamer cutters to the reamer cutting diameter.

9. A bottom hole assembly as defined in claim 1, wherein an axial spacing between the bend and the reamer is less than 15 times the reamer diameter.

10. A bottom hole assembly as defined in claim 1, wherein an axial spacing between the bend and the reamer is less than 12 times the reamer diameter.

11. A bottom hole assembly as defined in claim 1, wherein the gauge section has an axial length of at least 90% of the bit diameter.

12. A steerable bottom hole assembly for drilling a borehole, comprising:

a downhole motor having a motor housing and a bend angle, a motor housing enclosing a lower output rotor offset at a selected bend angle from a central axis of an upper motor housing;

the bit having a bit face defining a bit diameter;

a gauge section having a substantially uniform diameter bearing surface approximating the bit diameter, the gauge section having an axial length at least 75% of the bit diameter;

a reamer positioned between the downhole motor and the gauge section, the reamer including cutters radially moveable outwardly to a reamer cutting diameter for enlarging the borehole diameter substantially beyond the bit diameter; and an axial spacing between the bend and the reamer is less than 15 times the reamer diameter.

13. A bottom hole assembly as defined in claim 12, wherein an axial spacing between the bend and the reamer is less than 12 times the reamer diameter.

14. A bottom hole assembly as defined in claim 12, wherein the downhole motor is slick with no stabilizers for engaging the wall of the wellbore.

15. A bottom hole assembly as defined in claim 12, further comprising:

the output rotor having a pin connection at its lowermost end; and the reamer having a box connection at its upper end for mating interconnection with the pin connection.

16. A method of forming a subterranean borehole utilizing a steerable bottom hole assembly including a downhole motor having a motor housing and a bend angle, the motor housing enclosing a lower output rotor offset at a selected bend angle from a central axis of an upper motor housing, the method comprising:

providing a bit having a bit face defining a bit diameter;

providing a gauge section above the bit having a substantially uniform diameter bearing surface approximating the bit diameter, the gauge section having an axial length at least 75% of the bit diameter;

providing a reamer between the downhole motor and the gauge section, the reamer including cutting cutters for enlarging the borehole substantially beyond the bit diameter to a reamer cutting diameter;

axially spacing the bend and the reamer less than 15 times the reamer cutting diameter;

powering the motor with fluid to rotate the bit while the motor housing is slid to drill a curved section of the borehole; and rotating the bottom hole assembly from the surface to build a straight section of the borehole.

17. A method as defined in claim 16, further comprising:

providing a pin connection at a lowermost end of the output shaft from the downhole motor; and providing a box connection at the upper end of the reamer for interconnection with the pin connection.

18. A method as defined in claim 16, further comprising:

providing a single blade stabilizer above the bend in the downhole motor.

19. A method as defined in claim 16, wherein the gauge section has an axial length of at least 90% of the bit diameter.

20. A method as defined in claim 16, wherein fluid pressure in the bottom hole assembly moves the reamer cutter radially outward.

* * * * *